US008609314B2

(12) United States Patent
Kabai et al.

(10) Patent No.: US 8,609,314 B2
(45) Date of Patent: Dec. 17, 2013

(54) DEVELOPING AGENT AND METHOD OF MANUFACTURING THE SAME

(75) Inventors: Takahito Kabai, Shizuoka-ken (JP); Tsuyoshi Itou, Shizuoka-ken (JP); Takayasu Aoki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 271 days.

(21) Appl. No.: 12/980,735

(22) Filed: Dec. 29, 2010

(65) Prior Publication Data

US 2011/0183248 A1 Jul. 28, 2011

Related U.S. Application Data

(60) Provisional application No. 61/299,106, filed on Jan. 28, 2010.

(51) Int. Cl.
*G03G 9/08* (2006.01)

(52) U.S. Cl.
USPC ..... 430/110.1; 430/108.1

(58) Field of Classification Search
USPC ..... 430/110.1, 108.1
See application file for complete search history.

(56) References Cited

U.S. PATENT DOCUMENTS

| | | | |
|---|---|---|---|
| 6,203,603 | B1 | 3/2001 | Takayama et al. |
| 2009/0087767 | A1 | 4/2009 | Nakamura |
| 2010/0209839 | A1 | 8/2010 | Kabai et al. |
| 2011/0165507 | A1 | 7/2011 | Itou et al. |

FOREIGN PATENT DOCUMENTS

| | | | |
|---|---|---|---|
| EP | 1 041 447 | A1 | 10/2000 |
| EP | 1 655 638 | A1 | 5/2006 |

OTHER PUBLICATIONS

Extended European Search Report for European Patent Application No. 10196873.3 mailed on May 19, 2011.

*Primary Examiner* — Hoa V Le
(74) *Attorney, Agent, or Firm* — Turocy & Watson, LLP

(57) ABSTRACT

According to one embodiment, a method of manufacturing a color erasable developing agent including preparing a dispersion containing a fine particle containing a leuco dye and a developer, a fine particle containing a color erasing agent, a toner binder resin fine particle and a medium, aggregating the fine particles in the medium, and heat fusing the aggregate to form a toner particle is provided.

6 Claims, 1 Drawing Sheet

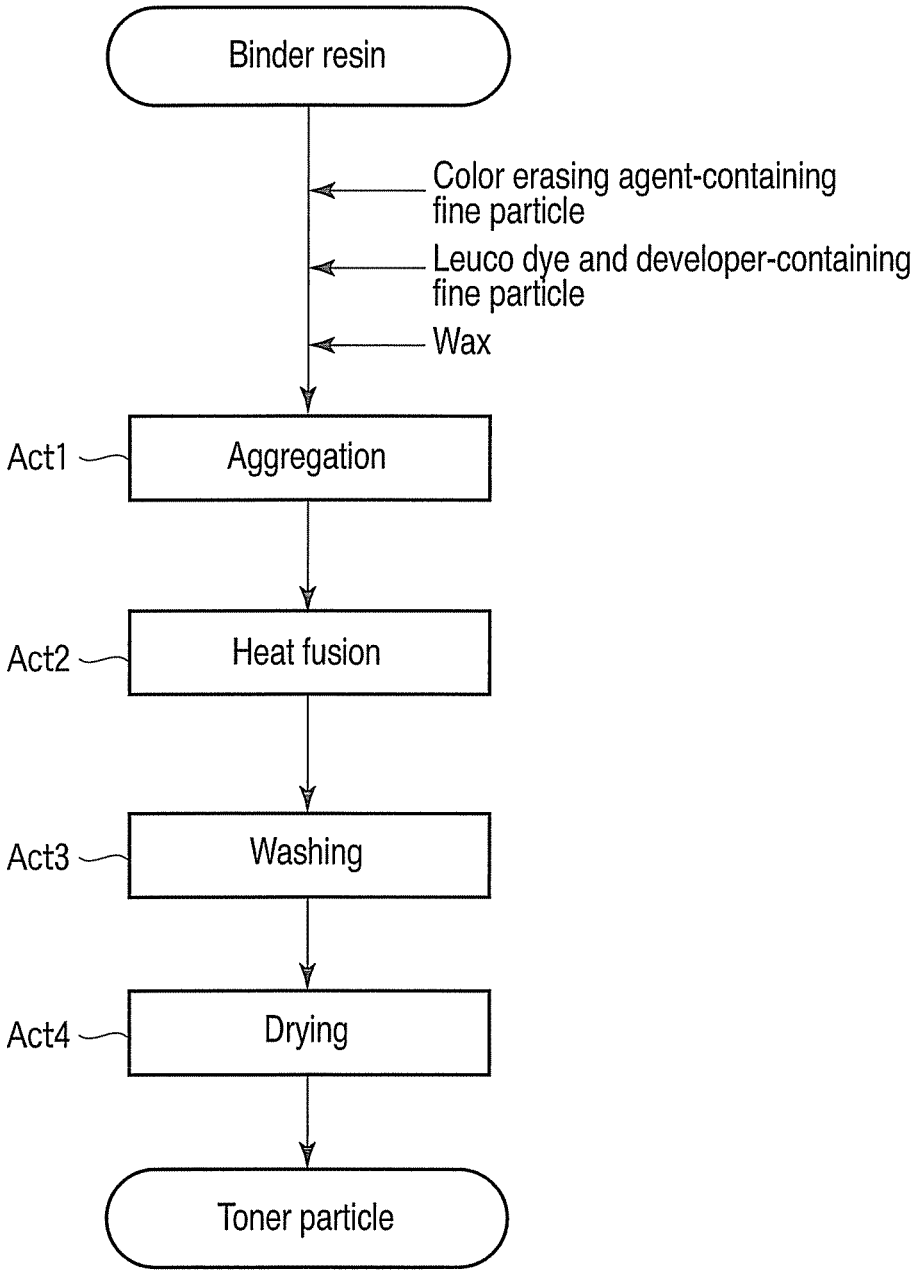
Binder resin
Color erasing agent-containing fine particle
Leuco dye and developer-containing fine particle
Wax
Act1
Aggregation
Act2
Heat fusion
Act3
Washing
Act4
Drying
Toner particle

DEVELOPING AGENT AND METHOD OF MANUFACTURING THE SAME

CROSS-REFERENCE TO RELATED APPLICATIONS

This application is based upon and claims the benefit of priority from U.S. Provisional Application No. 61/299,106 filed on Jan. 28, 2010; the entire contents of which are incorporated herein by reference.

FIELD

Embodiments described herein relate generally to an electrophotographic developing agent and a method of manufacturing the same.

BACKGROUND

A method of erasing colors of a toner image formed on a recording medium such as paper and reusing the recording medium such as paper is very effective from the viewpoints of environmental protection and economy by reducing the use amount of the recording medium.

There is proposed a method of obtaining an electrophotographic toner by aggregating and fusing a fine particle containing a leuco dye, a developer and/or a color erasing agent and a toner binder.

According to this method, when the color erasing agent is used in the fine particle, a so-called irreversible color erasing characteristic such that color restoration cannot be achieved can be obtained. However, when color erasing is performed in a manufacturing step of a fine particle and a toner, or in a fixing step at the image formation, the application cannot be achieved.

If the color erasing agent is not used in the fine particle, when color erasing is performed in a manufacturing step of a fine particle and a toner, color restoration is possible by a freezing step. Also, in view of the fact that a melting temperature of the fine particle and a melting temperature of the toner binder can be individually designed, the following relationship can be relatively easily satisfied.

(Toner Fixing Temperature)<(Toner Color Erasing Temperature)

However, by cooling the image to a prescribed temperature, color redevelopment is possible. For example, in a material which undergoes color redevelopment at a temperature relatively close to room temperature, the application is not substantially achieved. For that reason, when the color erasing agent is not used, there was involved such a problem that material types which can be used for the toner are limited.

BRIEF DESCRIPTION OF THE DRAWINGS

The single FIGURE is an exemplary flowchart showing a method for producing a developing agent according to one embodiment of the invention.

DETAILED DESCRIPTION

In general, according to one embodiment, there is provided a method of manufacturing a color erasable developing agent including preparing a dispersion containing a fine particle containing a leuco dye and a developer, a fine particle containing a color erasing agent, a toner binder resin fine particle and a medium; aggregating the fine particles in the medium; and heat fusing the aggregate to form a toner particle.

Also, according to another embodiment, there is obtained a color erasable developing agent including a toner particle obtained by heat fusing an aggregate of a fine particle containing a leuco dye and a developer, a fine particle containing a color erasing agent and a toner binder resin fine particle.

In the embodiment's, the toner particle can be obtained by adding an aggregating agent such as metal salts to a fine particle dispersion, intentionally breaking the dispersed state of each of the fine particles in a medium such as water to aggregate the fine particles, thereby obtaining an aggregated particle, and then heat treating the aggregated particle to fuse the aggregated particle.

The fusion can also be carried out simultaneously with the aggregation.

By adopting the method according to the embodiment, since the preparation is achieved by aggregating nano-order particles, it is possible to realize a small particle size, and by changing a condition of the heat treatment for undergoing the fusion, it is possible to vary the shape. Also, by adopting this method, it is possible to mix and granulate a color erasing raw material fine particle having a desired composition of a leuco dye or the like with a binder resin and the like without being broken by a mechanical shear force or the like.

Also, in view of the fact that so far as a temperature exceeds Tg of the binder resin, even when the temperature is, for example, relatively low as less than 80° C., fusion and granulation of the aggregate are possible, it is possible to manufacture a toner particle at a temperature of not higher than the color erasing temperature of the leuco dye or the like.

Furthermore, by adjusting a melting point of the color erasing agent-containing particle, it is possible to provide an inexpensive product while avoiding the color erasing in a manufacturing step and omitting a cooling step. Moreover, it is possible to avoid erasing in a fixing step at the image formation.

Since the color erasing agent in the fine particle elutes from the fine particle and may react with a coloring agent, the color erasing agent-containing fine particle may be melted and softened at the arrival at a color erasing temperature.

The color erasing agent-containing fine particle may contain a binder.

By choosing the binder material in such a manner that a melting temperature of the color erasing agent-containing fine particle is higher than the ultimate temperature at the image fixing so as to satisfy, for example, the following expression (1), it is possible to prevent color erasing at the image fixing from occurring.

$$(T2-T1)\geq 10^\circ\ \mathrm{C.} \quad (1)$$

In the expression, T1 represents a softening point of the toner binder resin; and T2 represents a melting temperature of the color erasing agent-containing fine particle.

(T2−T1) can be regulated to from 10 to 50° C.

When (T2−T1) is less than 10° C., the color erasing agent-containing fine particle tends to be slightly melted at the fixing to commence color erasing, whereas when it exceeds 50° C., softening by melting of the toner binder excessively proceeds at the color erasing, so that there is a tendency that a fault is possibly generated in a color erasing apparatus or the like.

For example, as the binder to be used in combination with the color erasing agent, a binder having a melting temperature higher than a softening point of the toner binder resin can be chosen.

Also, it is desirable that the color erasing agent-containing fine particle is instantly melted at the arrival at a color erasing temperature. Therefore, materials having a relatively high melting temperature and having sharp melt properties, such as metallic soaps, PP waxes and PE waxes, can be used as the binder.

As the toner binder resin, for example, polyesters, styrene-acrylate resins, epoxy resins, olefin resins and the like can be used.

As the fine particle containing a leuco dye and a developer, those which may be melted at the fixing can be used.

The leuco dye as referred to herein is an electron donating compound which can undergo color development with the developer. Examples thereof include diphenylmethane phthalides, phenylindolyl phthalides, indolyl phthalides, diphenylmethane azaphthalides, phenylindolyl azaphthalides, fluorans, styrynoquinolines and diazarhodamine lactones.

Specific examples thereof include 3,3-bis(p-dimethylaminophenyl)-6-dimethylamino phthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino) fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino) fluoran, 1,2-benz-6-(N-ethyl-N-isoamylamino)fluoran, 2-(3-methoxy-4-dodecoxystyryl)quinoline, spiro[5H-(1) benzopyrano(2,3-d)pyrimidin-5,1'(3'H)isobenzofuran]-3'-one, 2-(diethylamino)-8-(diethylamino)-4-methyl-, spiro [5H-(1)benzopyrano(2,3-d)pyrimidin-5,1'(3'H)isobenzo furan]-3'-one, 2-(di-n-butylamino)-8-(di-n-butylamino)-4-methyl-, spiro[5H-(1)benzopyrano(2,3-d)pyrimidin-5,1'(3'H)isobenzofuran]-3'-one, 2-(di-n-butylamino)-8-(diethylamino)-4-methyl-, spiro[5H-(1)benzopyrano(2,3-d)-pyrimidin-5,1'(3'H)isobenzofuran]-3'-one, 2-(di-n-butylamino)-8-(N-ethyl-N-i-amylamino)-4-methyl-, spiro [5H-(1)benzopyrano(2,3-d)pyrimidin-5,1'(3'H) isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide and 3-(2-ethoxy-4-diethylaminophenyl)-3-(1-pentyl-2-methylindol-3-yl)-4,5,6,7-tetrachlorophthalide. Furthermore, pyridine based, quinazoline based and bisquinazoline based compounds and the like can be exemplified. These compounds may be used in admixture of two or more kinds thereof.

The developer is, for example, an electron accepting compound capable of giving a proton to the leuco dye. Examples of the developer include phenols, phenol metal salts, carboxylic acid metal salts, aromatic carboxylic acids, aliphatic carboxylic acids having from 2 to 5 carbon atoms, benzophenones, sulfonic acid, sulfonic acid salts, phosphoric acids, phosphoric acid metal salts, acidic phosphoric acid esters, acidic phosphoric acid ester metal salts, phosphorous acids, phosphorous acid metal salts, monophenols, polyphenols and 1,2,3-triazole and derivatives thereof; furthermore, those compounds having, as a substituent thereof, an alkyl group, an aryl group, an acyl group, an alkoxycarbonyl group, a carboxy group or an ester or amide group thereof, a halogen group, or the like; and bis type or tris type phenols, phenol-aldehyde condensation resins, and metal salts thereof. These compounds may be used in admixture of two or more kinds thereof.

Specifically, phenol, o-cresol, tent-butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acids or esters thereof, for example, 2,3-dihydroxybenzoic acid, methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis(4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane, 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis (benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, methylene tris-p-cresol and the like can be used.

Examples of the color erasing agent include aliphatic higher alcohols, polyethylene glycol, nonionic surfactants, cationic surfactants and hindered amine derivatives.

Examples of the hindered amine derivative include tetrakis (1,2,2,6,6-pentamethyl-4-piperidyl)-1,2,3,4-butanetetracarboxylate, tetrakis(2,2,6,6-tetramethyl-4-piperidyl)butane-1,2,3,4-butanetetracarboxylate, a condensate of 1,2,3,4-butanetetracarboxylic acid, 1,2,2,6,6-pentamethyl-4-piperidinol and β,β,β,β-tetramethyl-3,9-(2,4,6,8,10-tetraoxaspiro[5,5]undecane)dimethanol, bis(2,2,6,6-tetramethyl-4-piperidyl)sebacate and tetrakis(1,2,2,6,6-pentamethyl-4-piperidyl)-1,2,3,4-butanetetracarboxylate. Also, as trade names of the hindered amine derivative, CHIMASSORB 2020 FDL, CHIMASSORB 944 FDL, TINUVIN 622 LD, TINUVIN 144, TINUVIN 765, TINUVIN 770 DF, TINUVIN 111 FDL, TINUVIN 783 FDL, TINUVIN 783 FDL and TINUVIN 791 FB, all of which are manufactured by Ciba Specialty Chemicals; ADK STAB LA52, ADK STAB LA57, ADK STAB LA63P, ADK STAB LA77Y, ADK STAB LA68LD, ADK STAB LA77G, ADK STAB LA402XP, ADK STAB LA502XP and ADEKA ARKLS DN-44M, all of which are manufactured by Adeka Corporation; and the like can be used.

In manufacturing the fine particle containing the developer and the coloring agent such as a leuco dye, it is possible to prepare the fine particle under a wide manufacturing condition because there is no concern that the fine particle reacts with the color erasing agent. Since the fine particle containing the developer and the coloring agent comes into contact with other toner composition only at a particle-to-particle interface, the leuco dye is hardly chemically influenced from the toner composition, and its color development characteristic is hardly hindered. Therefore, it is possible to choose an arbitrary toner composition such as a polyester resin or the like which has good toner characteristics.

By preparing the developer and the color erasing agent by individual particles, it is possible to relatively easily prepare a capsule particle. Also, the adjustment of a color erasing temperature becomes relatively easy.

Also, since the color erasing agent is used, it is possible to provide a so-called irreversible color erasing toner which does not undergo color restoration. Since a material having small temperature hysteresis can be used for the developer, a degree of freedom of material choice becomes high.

The color erasable developing agent according to the embodiment has a non-offset region of from 120 to 200° C., and at the image formation using this developing agent, a fixing temperature and a color erasing temperature can be regulated to from 120 to 170° C. and from 180 to 200° C., respectively.

FIG. 1 shows a flow expressing an example of a method of manufacturing a color erasable developing agent according to the embodiment.

A fine particle dispersion containing at least a developer and a coloring agent and a fine particle dispersion containing at least a color erasing agent are individually prepared and dispersed in a dispersion medium such as water together with a fine particle dispersion containing at least a toner binder resin. Subsequently, the dispersed fine particles are aggregated to obtain a particle having an approximately toner particle size (Act 1). The obtained aggregated particle is heat fused (Act 2). Thereafter, by performing washing (Act 3) and drying (Act 4), a toner particle can be obtained. Also, by optionally subjecting the obtained toner particle to a surface treatment such as external addition, a color erasable toner can be obtained.

A maximum temperature in the manufacturing step of the developing agent according to the embodiment is the temperature in the fusion step.

Also, as each of the fine particle of the fine particle dispersion containing the developer and the coloring agent and the fine particle containing the color erasing agent, an encapsulated fine particle can be used. As to a method of encapsulation, the leuco dye, the developer and the color erasing agent are incorporated into a coating film made of a resin, gelatin or the like together with a matrix by an interfacial polymerization method, a coacervation method, an in situ polymerization method, a drying-in-liquid method, an in-liquid curing coating method or the like. However, since it is necessary that at the arrival at a color erasing temperature, the capsule film is broken, or the color erasing agent penetrates into the capsule film, the material choice and thickness adjustment of the capsule film must be properly performed.

The embodiments are hereunder specifically described by reference to the following Example.

Preparation of Developer and Coloring Agent-Containing Fine Particle Dispersion

First of all, a leuco dye and a developer are melt mixed.

Leuco dye: CVL (manufactured by Yamamoto Chemicals Inc.) . . . 50 g

Developer: Bisphenol A . . . 100 g 150 g of the obtained melt mixture and 1,500 g of a 1% sodium dodecylbenzenesulfonate aqueous solution were mixed, and the mixture was heated to 60° C. and dispersed by using T25 (manufactured by IKA) which is a homogenizer.

The obtained particles had a volume average particle size of 12 μm.

Subsequently, the obtained particles were subjected to mechanical shearing at 150 MPa and 80° C. by a high-pressure type atomizer of NANO3000 (manufactured by Beryu Co., Ltd.) adapted with a hopper as a raw material charging part; a 12 m-long high-pressure conduit for heat exchange dipped in an oil bath as a heating part; a high-pressure conduit including connected nozzles of 0.13 μm and 0.28 μm, respectively as a pressurizing part; a medium-pressure conduit including connected cells having a pore diameter of 0.4 μm, 1.0 μm, 0.75 μm, 1.5 μm and 1.0 μm, respectively as a pressure reducing part; and a 12 m-long heat exchange conduit which can be cooled with tap water as a cooling part, thereby performing atomization. The obtained fine particles had a volume average particle size of 0.2 μm. This dispersion was cooled in a freezer and then allowed to stand at ordinary temperature, thereby obtaining a blue colored fine particle dispersion.

Preparation of Color Erasing Agent-Containing Fine Particle Dispersion

A color erasing agent and a binder resin A are melt mixed.

Color erasing agent: Cholic acid . . . 50 g

Binder resin A: Polyester resin (Tm=135° C.) . . . 100 g 150 g of the obtained melt mixture and 1,500 g of a 1% sodium dodecylbenzenesulfonate aqueous solution were mixed, and the mixture was heated to 60° C. and dispersed by using T25 (manufactured by IKA) which is a homogenizer.

The obtained particles had a volume average particle size of 12 μm.

Subsequently, the obtained particles were subjected to mechanical shearing at 150 MPa and 80° C. by a high-pressure type atomizer of NANO3000 (manufactured by Beryu Co., Ltd.) adapted with a hopper as a raw material charging part; a 12 m-long high-pressure conduit for heat exchange dipped in an oil bath as a heating part; a high-pressure conduit including connected nozzles of 0.13 μm and 0.28 μm, respectively as a pressurizing part; a medium-pressure conduit including connected cells having a pore diameter of 0.4 μm, 1.0 μm, 0.75 μm, 1.5 μm and 1.0 μm, respectively as a pressure reducing part; and a 12 m-long heat exchange conduit which can be cooled with tap water as a cooling part, thereby performing atomization. The obtained fine particles had a volume average particle size of 0.2 μm.

Preparation of Toner Composition Fine Particle Containing Toner Binder Resin

A toner binder composition fine particle dispersion containing a toner binder B (Tm=110° C.) was prepared in the following manner.

A toner binder composition (94 wt % of a polyester resin for toner binder, 5 wt % of a rice wax, LAX-N-300A and 1 wt % of TN-105, manufactured by Hodogaya Chemical Co., Ltd.) is homogenized and mixed in a dry type mixer and then melt kneaded by a two-screw kneader (PCM-45, Ikegai Corporation).

The obtained toner composition is pulverized to a size of 2 mm-mesh pass by a pin mill.

The toner composition pulverized material (30 weight %) is dispersed in pure water (68.65%) together with a surfactant, PELEX-SSL (0.9 weight %), manufactured by Kao Corporation and a neutralizing agent, dimethylaminoethanol (0.45 weight %).

The dispersion is passed through a high-pressure homogenizer (NANO3000, manufactured by Beryu Co., Ltd.), thereby obtaining a fine particle dispersion of about 200 nm.

As the toner composition fine particle containing a toner binder, a fine particle obtained by mechanical emulsification and emulsion polymerization of a styrene-acrylate resin and a particle obtained by depositing the resin dissolved in an organic solvent by a phase inversion emulsification method or the like can also be used.

Aggregation and Fusion

The leuco dye-containing fine particle dispersion, the color erasing agent-containing fine particle dispersion and the toner composition fine particle dispersion are mixed in a ratio of 10/10/80, and aluminum sulfate is added at 40° C. while stirring.

The temperature is gradually elevated while stirring, and the mixture is kept at 80° C., thereby obtaining a fused particle having a particle size of 10 μm.

For the aggregation, aggregation with a monovalent or polyvalent metal salt such as sodium chloride, potassium chloride, magnesium sulfate and aluminum sulfate, aggregation by pH modification with hydrochloric acid or the like, aggregation with an organic coagulant such as a dimethyldiallylammonium chloride homopolymer, or the like can be adopted.

Also, for the purpose of high functionalization of the toner particle or the like, arbitrary materials can be added at an arbitrary stage of the aggregation and fusion steps within the range where the embodiments are not deviated.

Washing, Drying and External Addition Treatments

Washing and filtration are repeated by an arbitrary method using filter paper, a filter press or the like, thereby obtaining a hydrous cake. The hydrous cake is dried to a water content of about 1 wt % by using an arbitrary drying apparatus such as a flash dryer, a vibration dryer and an oven. The dried material is broken by an arbitrary method by using, for example, a Henschel mixer. The obtained dried particle had a volume average particle size of 10 μm. An external treatment with silica, titanium oxide or the like is performed to obtain a color erasable toner.

Image Formation

The obtained color erasable toner was mixed with a silicone resin-coated ferrite carrier, and an image was outputted using a modified machine of MFP (e-estudio 4520c), manufactured by Toshiba Tec Corporation. A temperature of a fixing unit was set up at from 120 to 160° C., and a paper feed rate was adjusted to 100 mm/sec, thereby obtaining an image having an image density of 1.0.

Confirmation of Color Erasing of Image

By setting up a temperature of a fixing unit at from 180 to 190° C. and delivering the obtained image at a paper feed rate of 100 mm/sec, it was confirmed that the image became transparent. Also, image offset was not generated on the fixing unit at the color erasing.

Confirmation of Color Restoration of Image

The color erased image was stored in a freezer at −30° C. As a result, it was confirmed that color restoration was not caused.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A toner comprising:

a resin particle containing a first binder resin;

a first particle containing a developer and a coloring agent, and a second particle containing a second binder resin differing from the first binder resin and a color erasing agent in the second binder resin, and obtained by aggregating and heat fusing the resin particle, the first particle, and the second particle, wherein a melting temperature of the second particle is higher by at least 10° C. than a softening point of the first binder resin, and the developer and the coloring agent are not color erased influenced by the color erasing agent when the first binder resin is melted.

2. A toner according to claim 1, wherein the softening point of the second binder resin is higher than the softening point of the first binder resin.

3. A toner according to claim 1, wherein the second particle is dispersed in an aqueous dispersion and is subjected to mechanical shearing to be atomized.

4. A toner comprising:

a resin particle containing a first binder resin;

a first particle containing a developer and a coloring agent, and a second particle having a size on the order of nanometers, containing a second binder resin differing from the first binder resin and a color erasing agent in the second binder resin, and obtained by aggregating and heat fusing the resin particle, the first particle, and the second particle, wherein a melting temperature of the second particle is higher by at least 10° C. than a softening point of the first binder resin, and the developer and the coloring agent are not color erased influenced by the color erasing agent when the first binder resin is melted.

5. A toner according to claim 4, wherein the softening point of the second binder resin is higher than the softening point of the first binder resin.

6. A toner according to claim 4, wherein the second particle is dispersed in an aqueous dispersion and is subjected to mechanical shearing to be atomized.

* * * * *